US008695193B2

(12) United States Patent
Kress et al.

(10) Patent No.: US 8,695,193 B2
(45) Date of Patent: Apr. 15, 2014

(54) WEIGHTED RIBBONS AND DUMPLINGS FOR CURTAINS AND OTHER APPLICATIONS, AND METHOD OF MANUFACTURE THEREFOR

(75) Inventors: William D. Kress, Commerce, GA (US); Rodney Loren Smith, Ephrata, PA (US); William Donald Sauerhoefer, Reinholds, PA (US)

(73) Assignee: Kress Design, LLC, Duluth, GA (US)

( * ) Notice: Subject to any disclaimer, the term of this patent is extended or adjusted under 35 U.S.C. 154(b) by 759 days.

(21) Appl. No.: 12/621,643

(22) Filed: Nov. 19, 2009

(65) Prior Publication Data

US 2011/0113610 A1 May 19, 2011
US 2011/0277295 A2 Nov. 17, 2011

(51) Int. Cl.
*B23P 17/00* (2006.01)
*A47H 1/00* (2006.01)

(52) U.S. Cl.
USPC ..... 29/414; 29/412; 112/475.06; 160/349.1

(58) Field of Classification Search
USPC ..... 160/348, 349.1, 349.2; 112/153, 112/475.06; 29/412, 414, 413
See application file for complete search history.

(56) References Cited

U.S. PATENT DOCUMENTS

| | | | | |
|---|---|---|---|---|
| 1,828,678 | A | | 10/1931 | Peterman et al. |
| 1,936,198 | A | | 11/1933 | Kirsch |
| 2,245,285 | A | | 6/1941 | Loeb |
| 2,272,656 | A | | 2/1942 | Byron |
| 2,319,292 | A | * | 5/1943 | Boggs ..... 2/96 |
| 2,642,577 | A | | 6/1953 | Sherman |
| 3,107,361 | A | | 10/1963 | Glutting, Sr. |
| 3,224,495 | A | | 12/1965 | Truesdale |
| 3,235,926 | A | | 2/1966 | Mates |
| 3,259,151 | A | | 7/1966 | Schmitz |
| 3,295,264 | A | | 1/1967 | Olson |
| 3,360,015 | A | * | 12/1967 | Hughes ..... 139/389 |
| 3,372,729 | A | | 3/1968 | Lindenmayer |
| 3,439,438 | A | | 4/1969 | Tuskos |
| 3,577,307 | A | | 5/1971 | Baier et al. |
| 3,613,967 | A | | 10/1971 | Clement |
| 3,613,968 | A | | 10/1971 | Kirche |
| 3,667,659 | A | | 6/1972 | Clement |
| 3,673,045 | A | | 6/1972 | Baier et al. |
| 3,684,608 | A | | 8/1972 | Schmitz et al. |
| 3,738,007 | A | | 6/1973 | Tuskos |

(Continued)

FOREIGN PATENT DOCUMENTS

| | | | |
|---|---|---|---|
| DE | 29705451 | U1 | 7/1997 |
| EP | 1136021 | A2 | 9/2001 |

(Continued)

OTHER PUBLICATIONS

Textol Systems, Inc. Drapery Supplies, Internet Catalog. http://textol-px.rtrk.com/d_items.asp?cat=04 Accessed May 28, 2009; 4 pgs.

(Continued)

*Primary Examiner* — David Bryant
*Assistant Examiner* — Jason L Vaughan
(74) *Attorney, Agent, or Firm* — Thompson Hine LLP

(57) ABSTRACT

Apparatus and methods for the manufacture of weighted ribbons are disclosed, and which weighted ribbons are for use in association with curtains and in other applications.

19 Claims, 6 Drawing Sheets

(56) References Cited

U.S. PATENT DOCUMENTS

| | | | | | |
|---|---|---|---|---|---|
| 3,802,609 | A | | 4/1974 | Benedetto | |
| 3,818,970 | A | | 6/1974 | Schmitz et al. | |
| 4,142,570 | A | | 3/1979 | Heimberg | |
| 4,167,434 | A | | 9/1979 | Morgan | |
| 4,392,360 | A | | 7/1983 | Gidge et al. | |
| 4,663,915 | A | * | 5/1987 | Van Erden et al. | 53/450 |
| 4,761,945 | A | | 8/1988 | Büunger | |
| 4,770,224 | A | | 9/1988 | Dubbelman | |
| 5,247,781 | A | * | 9/1993 | Runge | 53/412 |
| 6,131,639 | A | * | 10/2000 | McMillen et al. | 160/123 |
| 6,301,754 | B1 | * | 10/2001 | Grunberger et al. | 24/303 |
| 6,336,232 | B1 | | 1/2002 | Toder | |
| 6,761,207 | B1 | | 7/2004 | Homer | |
| 2003/0056333 | A1 | | 3/2003 | Boyle | |

FOREIGN PATENT DOCUMENTS

| | | | |
|---|---|---|---|
| JP | 2000166754 | A | 6/2000 |
| JP | 2002238736 | A | 8/2002 |
| JP | 2003153795 | A | 5/2003 |
| JP | 2003180510 | A | 7/2003 |
| JP | 2003199670 | A | 7/2003 |
| JP | 2006141730 | A | 6/2006 |
| JP | 2006320627 | A | 11/2006 |

OTHER PUBLICATIONS

Drapery Sewing Supplies.com. http://www.draperysewingsupplies.com/Drapery-Weight-p/sw25.htm Accessed May 28, 2009; 1 pg.

Rowley-Company LLC, excerpts from product catalog, May 17, 2009; 2 pgs. (See also, online catalog accessible via www.web-rowley.com).

Trademark Office Action, mailed Sep. 22, 2010, in connection with Trademark U.S. Appl. No. 85/062,206; 9 pgs.

Trademark Office Action, mailed Jun. 26, 2011, in connection with Trademark U.S. Appl. No. 85/062,206; 27 pgs.

Crown Novelty, Specification Sheets variously dated from 1973-1992; 10 pgs.

Digital photographs of products publicly available prior to the earliest effective filing date of Applicants' claimed invention of U.S. Appl. No. 12/621,643; 6 pgs.

* cited by examiner

WEIGHTED RIBBONS AND DUMPLINGS FOR CURTAINS AND OTHER APPLICATIONS, AND METHOD OF MANUFACTURE THEREFOR

TECHNICAL FIELD

The present disclosure relates, generally, to curtain weights, and, more particularly, to selectable length weighted ribbons, and individual dumplings separable therefrom, together with an associated method of manufacture therefor, and which weighted ribbons and/or dumplings may be used in association with curtains and in other applications.

BACKGROUND OF THE INVENTION

Curtain weighting systems are often used in venues wherein it is important that a curtain hang straight. For example, such weighting systems are most preferably used in situations where the sweeping motion of bi-parting curtains, as they open and close (whether activated manually or by motorized means), must be smooth and pleasant in accord with visual and sensory expectations of, for example, a theater audience.

Curtain weighting systems may further be used in industrial applications, wherein it is important that a curtain be returned quickly and accurately to a closed position. An example of such an application is an industrial loading dock door comprising a vinyl or plasticized curtain of uniform or segmented design, or a screen, wherein forklifts, pallet-moving equipment, or the like, repeatedly traverse the door and curtain arrangement.

Curtain weighting systems are additionally beneficial to ensure that folds and wrinkles may smooth or hang out faster. This is especially true with regard to theater curtains and other curtains used in public facilities, where the fabrics for such curtains have been treated with flame retardants (as required under local fire code for public safety), but where typical flame retardant treatments, especially those used in association with cotton fabrics, render impractical the use of steaming or ironing processes for removal of fold lines and wrinkles. Specifically, steaming or ironing processes can degrade or destroy the flame retardant compound, creating an unsafe condition, and/or can bring the flame retardant to the surface of the fabric, thereby leaving a white residue on the fabric surface and thus ruining the curtain. Of course, steaming or ironing, in general, may also cause the fabric to shrink from its finished size. Accordingly, curtain weighting systems may beneficially contribute to the smooth appearance of such curtains, while avoiding the consequences of adverse steaming and ironing processes.

Curtain weighting systems may be applied to curtains, either in horizontally or vertically disposed arrangement, most often within a hem, depending upon the user's application. Individual weights are sometimes placed within a pocket formed adjacent a lower margin of the curtain, or near or within a hem, or are pinned to an appropriate area near the curtain margin. Such prior art curtain weighting systems are of varying designs, most typically of a corded or chained arrangement. Exemplars of such designs may be seen with reference to United States Patent Application Publication Number US 2003/0056333 to Boyle, U.S. Pat. Nos. 3,577,307 and 3,673,045 to Baier et al., and U.S. Pat. No. 3,259,151 to Schmitz. Some systems comprise weighted pins, as may be seen with reference to U.S. Pat. No. 1,936,198 to Kirsch, and U.S. Pat. No. 1,828,678 to Peterman et al.

Other systems, such as may be seen with reference to FIG. 2 herein (Crown Novelty Works Corp., Holly Springs, Miss., USA), comprise a plurality of individual lead weights, sewn or otherwise glued to a strip of backing material, the backing material typically being of cotton. This strip bearing the plurality of lead weights is then surrounded by facing strips, again typically of cotton material, and closed by sewing along the top and bottom lengths of the strips (as shown in FIG. 2).

It will be immediately recognized by one of ordinary skill in the art that the above-referenced systems typically utilize lead weights due to their ease of puncturing during sewing processes. However, it is well known that lead is a hazardous material, and may cause or contribute to chronic conditions such as kidney damage, nervous system damage, hypertension, and reproductive system damage. Furthermore, when lead is heated to high temperatures, such as might be experienced during a fire, toxic decomposition products are released, and explosion dangers are possible if placed in contact with water. For these reasons, lead is not a preferred weighting material for use in private or public applications, and it has thus become increasingly difficult to secure domestic supplies of lead for fabrication of the required weights.

It will also be recognized by one of ordinary skill in the art that such prior art weighting systems are often less than optimally conducive to mechanical division from strip form into separate weight units, or into selected lengths. This is because cutting between the weights leaves, at best, an unfinished fabric edge that may unravel without end. At worst, cutting the strip between weights leaves open the individual segment at one or both ends, thus exposing the leaden weight therewithin. Most often, both circumstances occur.

Further disadvantageously, the components of such prior art weighting systems are sewn or stitched together according to well-known, single-line seams. This manner of construction may further contribute to the unraveling of fabric edges, together with exposure and/or loss of the internal leaden weights. Yet additionally, such prior art systems are often not flame retardant and are not typically subject to flame testing.

Thus, it is clear that there is an unmet need for a weight system, with associated methods of fabrication and use of such a weight system, that avoids the use of leaden weights; that allows for convenient, safe, and secure separation of a larger "roll stock" of weighted ribbon into smaller selected lengths of multi-weight ribbon, or into individual weight segments; that provides for securely fused edges or seals, even upon separation of a larger "roll stock" of weighted ribbon into smaller selected lengths of multi-weight ribbon, or into individual weight segments; that avoids the use of sewn or stitched seams as a structural component of the weighted ribbon; that is pretreated to provide flame retardant characteristics or is inherently flame retardant; and that is convenient and safe to fabricate and to use.

BRIEF SUMMARY OF THE INVENTION

Briefly described, in a preferred embodiment, the system and method of the present invention overcome the above-mentioned disadvantages and meet the recognized need for such a system and method by providing a fire retardant, polymer strip or "ribbon," preferably of woven, fusible, polyester fabric, which is v-folded to form a closed-end along the longitudinal length of the ribbon, and to thus provide a trough-like structure for the receipt of uniformly dimensioned weights therewithin. The weights preferably are formed of galvanized or stainless steel (and are lead-free), each of which is inserted into the ribbon in a spaced array, and preferably at specific intervals. The polymer ribbon is then preferably ultrasonically or heat sealed (or fused) at least between each weight to form a plurality of individual weight segments along the ribbon's length, each individual weight segment otherwise called a "dumpling." Yet additionally, a longitudinal seal is formed through the length of the entire ribbon (via ultrasonic or heat sealing), preferably just below the abutting top edges of the trough-like or v-folded ribbon. As such, each individual weight is maintained, captured or otherwise encapsulated within side seals, a top seal, and a closed-end.

More specifically, and with regard to the side seals, ultrasonic or heat sealing technology is used to form double seals between each weight, such that individual weight dumplings, or selected lengths of multi-weight ribbon, can be separated from a larger "roll stock" of such weighted ribbon by cutting through an unsealed section defined by, and disposed between, any of the double seals. Alternatively, ultrasonic or heat sealing technology is used to form a single fused section (i.e., a broad-single-seal) of substantial width in its lateral dimension between each weight, such that the weighted ribbon may be cut within the broad-single-seal to similarly provide individual weight dumplings, or selected lengths of multi-weight ribbon, from a larger "roll stock" of such weighted ribbon.

In either of the double-seal or broad-single-seal embodiments, individual weight dumplings and/or selected lengths of multi-weight ribbon may be cut from a larger "roll stock" of such weighted ribbon without causing dysfunctional fraying and/or unraveling of the woven ribbon material proximate the cut(s), and thus exposure of the weight(s) within the ribbon trough. In sum, the double-seals and the broad-single-seals provide a digitally-defined point, region or section for transverse division or cutting of the weighted ribbon into discrete lengths (or "loose" dumplings), and thus prevent loss of any weight(s) adjacent to such a transverse cut or division of the weighted ribbon. Yet additionally, the double-seals and the broad-single-seals provide a fray-reduction element or fray stopping point when the weighted ribbon is cut to provide discrete lengths (or "loose" dumplings).

The preferred weight is relatively thin and flat, and of uniform width and height, in order that the finished ribbon and/or dumpling products lie flat and unobtrusively against the curtain or fabric member with which it is to be used. In the preferred embodiment, the unit ribbon weight, or, alternatively, the unit dumpling weight, is selected by providing a relatively thicker or thinner weight, the width and height dimensions being otherwise preferably unaffected.

In use, a preselected length or precut section of weighted ribbon, or an individual dumpling, is sewn or otherwise affixed to a curtain or other fabric material member in a location consistent with the intended use. This location may be within a formed hem, in a seam, at a fabric margin, or otherwise at the user's discretion.

In addition or as an alternative to sewing, the manner of affixing the weighted ribbon or dumpling to a curtain or other fabric member may also be via cooperating hook and loop fasteners, cooperating mechanical snap means, cooperating button and hole means, adhesives, adhesive tapes, or the like.

Thus, and uniquely advantageous to the present invention, the weight system described herein avoids the use of leaden weights; allows for convenient, safe, and secure separation of a larger "roll stock" of weighted ribbon into smaller selected lengths of multi-weight ribbon, or into individual weight segments (i.e., individual weight dumplings); provides for securely fused edges or seals, even upon cutting or separation of a larger "roll stock" of weighted ribbon into smaller selected lengths of multi-weight ribbon, or into individual weight dumplings; avoids the use of sewn or stitched seams as a structural component of the weighted ribbon; is pretreated to provide flame retardant characteristics or, alternatively, is inherently flame retardant; and is convenient and safe to fabricate and to use.

Accordingly, one feature and advantage of the system and method of the present invention is the ability to avoid the use of leaden weights.

Another feature and advantage of the system and method of the present invention is to allow for convenient, safe, and secure cutting or separation of a larger "roll stock" of weighted ribbon into smaller selected lengths of multi-weight ribbon, or into individual weight segments (i.e., dumplings).

Another and further feature and advantage of the system and method of the present invention is to provide for securely fused edges or seals, even upon cutting or separation of a larger "roll stock" of weighted ribbon into smaller selected lengths of multi-weight ribbon, or into individual weight dumplings.

Another and still further feature and advantage of the system and method of the present invention is to avoid the use of sewn or stitched seams as a structural component of the weighted ribbon.

Another feature and yet still further advantage of the system and method of the present invention is to provide flame retardant characteristics.

Another feature and further advantage of the system and method of the present invention is to provide a system incorporating a preferred weight that is relatively thin and flat, and of uniform width and height, in order that the finished ribbon and/or dumpling products lie flat and unobtrusively against the curtain or fabric member with which it is to be used.

Another feature and further advantage of the system and method of the present invention is that the unit ribbon weight, or, alternatively, the unit dumpling weight, may be selected by providing a relatively thicker or thinner weight, the width and height dimensions being otherwise preferably unaffected.

Another feature and further advantage of the system and method of the present invention is to provide a weighting system that is convenient and safe to fabricate and to use.

These and other features and advantages of the system and method of the present invention will become apparent to those ordinarily skilled in the art after reading the following Detailed Description of the Invention and Claims in light of the accompanying drawing Figures.

BRIEF DESCRIPTION OF THE DRAWINGS

Accordingly, the system and method of the present invention will be understood best through consideration of, and with reference to, the following drawings, viewed in conjunction with the Detailed Description of the Invention referring thereto, in which like reference numbers throughout the various drawings designate like structure, and in which.

Figure 1:
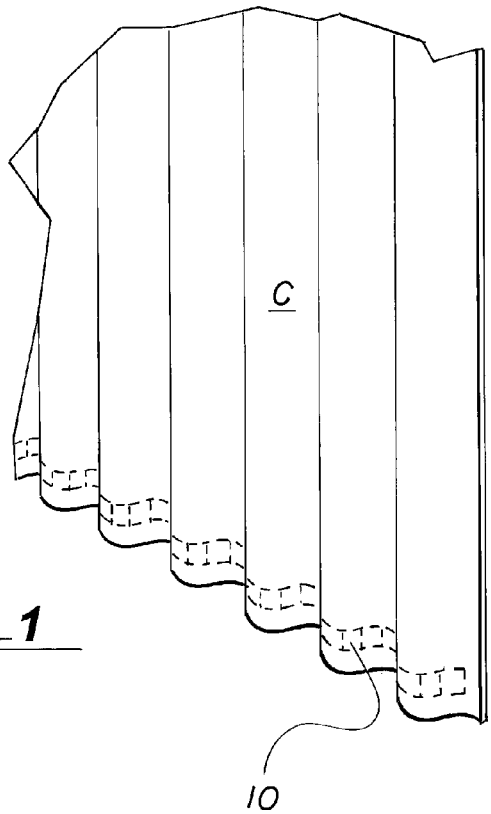
FIG. 1 is an exemplary curtain carrying a section of weighted ribbon according to the present invention.
Figure 6:
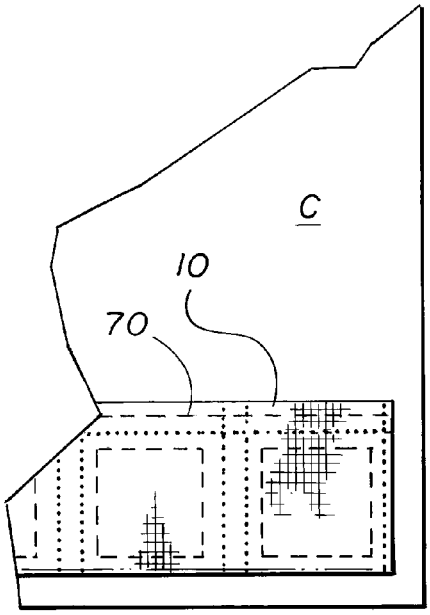
FIG. 6 is a sectional view of a curtain member carrying a horizontally disposed section of weighted ribbon in accordance with the present invention.
Figure 7:
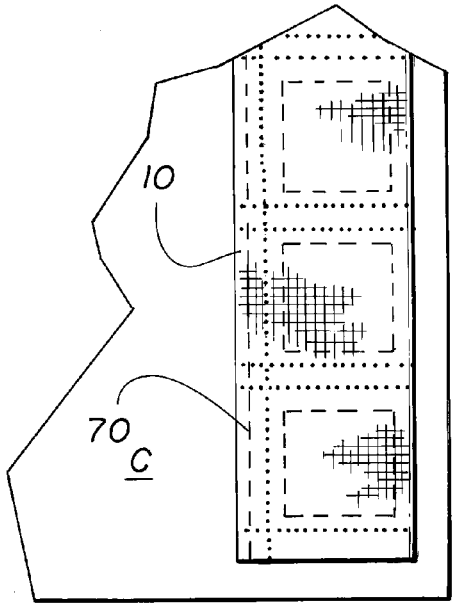
FIG. 7 is a sectional view of a curtain member carrying a vertically disposed section of weighted ribbon in accordance with the present invention.
Figure 2:
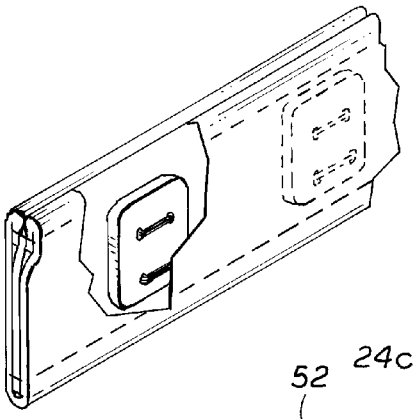
Fig. 2 PRIOR ART
FIG. 2 depicts a prior art curtain weight strip construction, and shows a partial sectional view thereof (Crown Novelty Works Corp., Holly Springs, Miss., USA)

It is to be noted that the drawing Figures presented are intended solely for the purpose of illustration and that they are, therefore, neither desired nor intended to limit the claimed invention to any or all of the exact details of construction shown, except insofar as they may be deemed essential to the claimed invention.

DETAILED DESCRIPTION OF THE INVENTION

In describing preferred and alternate embodiments of the system and method of the present disclosure illustrated in the drawing Figures, specific terminology is employed for the sake of clarity. The claimed invention, however, is not intended to be limited to the specific terminology so selected, and it is to be understood that each specific element includes all technical equivalents that operate in a similar manner to accomplish a similar purpose.

In that form of the preferred embodiment of the system and method of the present invention chosen for purposes of illustration, FIG. 1 shows curtain C carrying a section of weighted ribbon 10 according to the present invention.

Figure 3:
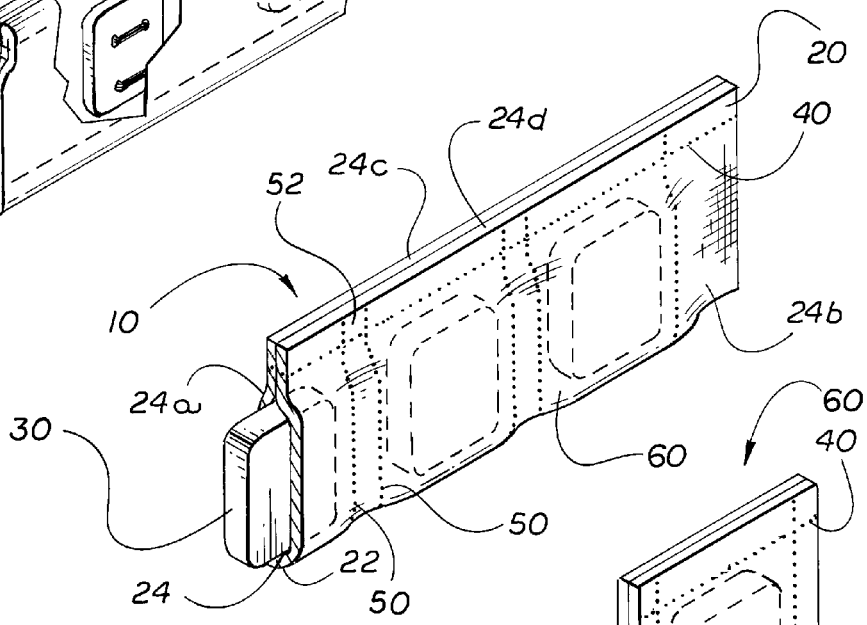
FIG. 3 depicts a portion of a weighted ribbon according to the present invention, and shows a partial sectional view thereof.

As best seen with reference to FIG. 3, weighted ribbon 10 provides a fire retardant, polymer strip or "ribbon" 20, preferably of an ultrasonically-sealable and/or heat-sealable (i.e., fusible), woven polyester fabric. Of course, ribbon 20 may be of any other suitable heat-sealable and/or ultrasonically-sealable woven fabrics, non-woven fabrics, mesh fabrics (either woven or non-woven), films, and/or woven/non-woven fabric and film composites (including mesh fabric and film composites), such as those formed from, but not limited to, polypropylene, polyethylene, and polyolefin.

Ribbon 20 is preferably v-folded to provide a closed-end 22 along the length of ribbon 20, and to thus form a trough 24 for the receipt of uniformly dimensioned weights 30 therewithin. Trough 24 preferably comprises sides 24*a* and 24*b*, and top edges 24*c*, 24*d*. Weights 30 preferably are formed of galvanized or stainless steel or other suitable non-staining metals (and are lead-free), each of which are positioned within trough 24 of v-folded ribbon 20, and preferably at specific intervals or any other selected spaced array.

Polymer ribbon 20 is preferably ultrasonically or heat sealed (fused) to form longitudinal seal 40, proximate the abutting top edges 24*c*, 24*d* of trough 24, and to further form transverse double seals 50, to thus provide a plurality of individual weight segments 60 along the length of ribbon 20, each individual weight segment 60 otherwise called a "dumpling." Transverse double seals 50 preferably extend from closed-end 22, through longitudinal seal 40, and to top edges 24*c*, 24*d* of trough 24. As such, each individual weight 30 within weighted ribbon 10 is maintained, captured or otherwise encapsulated within respective "side" seals 50, a "top" longitudinal seal 40, and a "bottom" closed-end 22.

Figure 4:
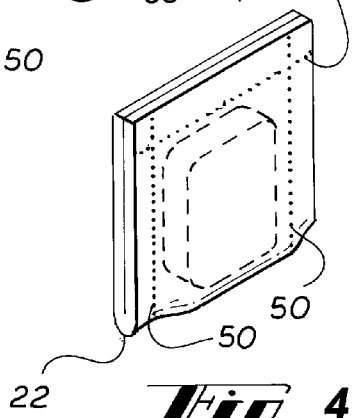
FIG. 4 depicts an individual weight dumpling according to the present invention.
Figure 14:
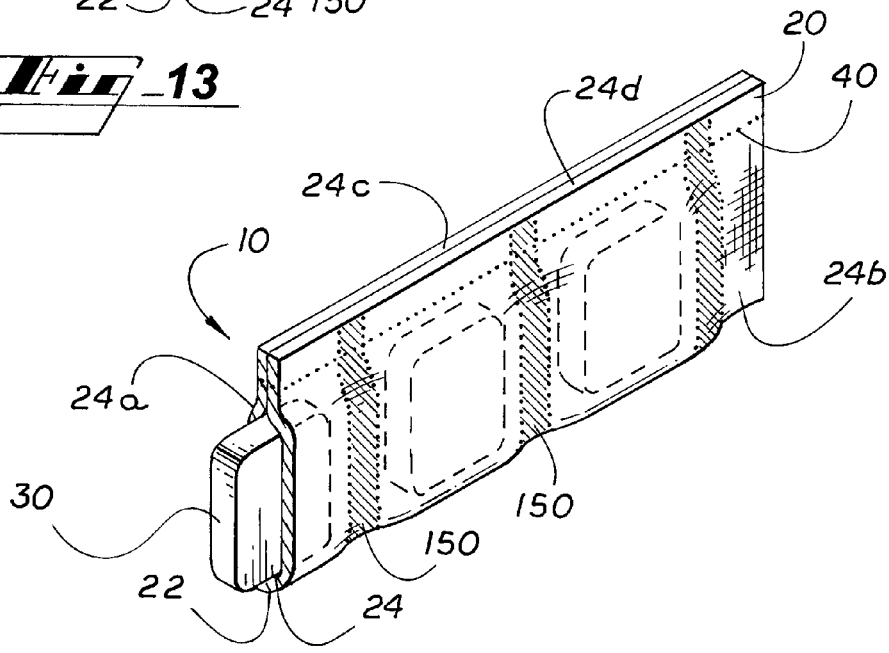
FIG. 14 depicts a portion of a weighted ribbon according to an alternate embodiment of the present invention, and shows a partial sectional view thereof.
Figure 15:
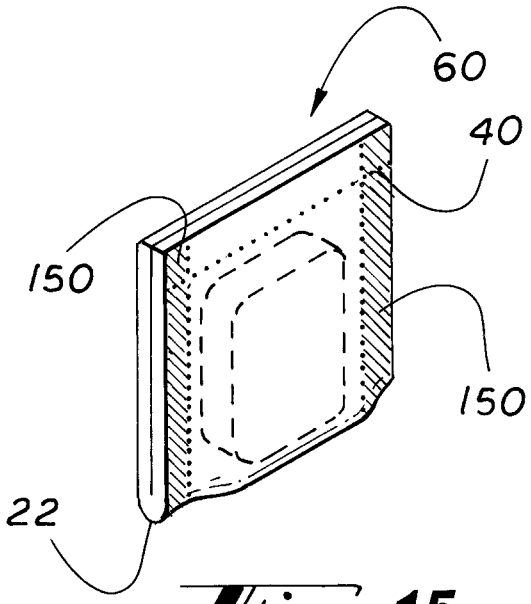
FIG. 15 depicts an individual weight dumpling according to an alternate embodiment of the present invention; and, FIG. 16 depicts an individual weight dumpling according to an alternate embodiment of the present invention.
Figure 16:
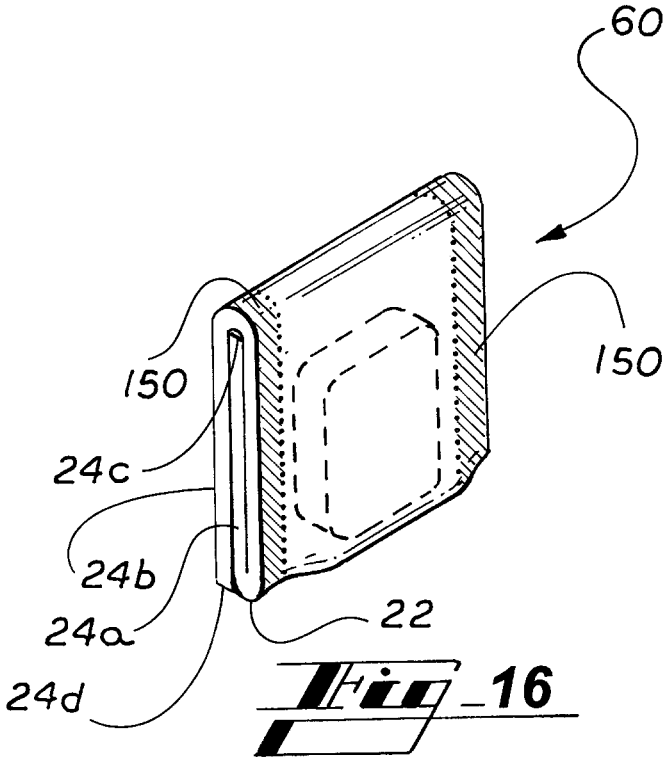

Specifically, between each weight 30 are formed transverse double seals 50, such that "loose" individual weight dumplings (see, FIG. 4), or desired sections or lengths of multi-weight ribbon 10, can be separated by cutting through the unsealed sections 52 between any selected double seals 50. Alternatively, and with reference to FIG. 14, ultrasonic or heat sealing technology is used to form a transverse single seal or fused section 150 (i.e., a broad-single-seal), of substantial width in its lateral dimension, between the individual weight segments 60, such that weighted ribbon 10 may be cut within the broad-single-seal 150 to similarly provide "loose" individual weight dumplings 60 (see, FIG. 15), or selected sections or lengths of multi-weight ribbon 10. Broad-single-seals 150 also preferably extend from closed-end 22, through longitudinal seal 40, and to top edges 24*c*, 24*d* of trough 24. As such, each individual weight 30 within weighted ribbon 10 is maintained, captured or otherwise encapsulated within respective "side" seals 150, a "top" longitudinal seal 40, and a "bottom" closed-end 22.

In either of the double-seal 50 or broad-single-seal 150 embodiments, such loose individual weight dumplings 60 and/or selected lengths of multi-weight ribbon 10 may be cut from a larger "roll stock" of such weighted ribbon 10 without causing endless fraying and/or unraveling of the woven ribbon 20 proximate the cut(s), and thus exposure and/or loss of weight(s) 30 within trough 24. Specifically, double-seals 50 and broad-single-seals 150 provide a digitally-defined point, region or section for transverse division or cutting of weighted ribbon 10 into discrete lengths (or "loose" dumplings), and thus prevent loss of any weight(s) 30 adjacent to such a transverse cut or division of weighted ribbon 10. Yet additionally, and most fundamentally, seals 50, 150 provide a fray-reduction element or fray stopping point when ribbon 10 is cut to provide discrete lengths (or "loose" dumplings).

Figure 5:
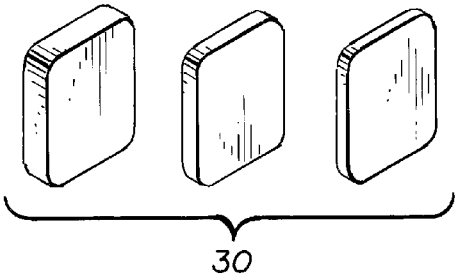
FIG. 5 depicts the structure of individual weights for use in association with the present invention, and further depicts varying thicknesses thereof for selected use.

With reference to FIG. 5, the preferred weight 30 is substantially square in shape, relatively thin and flat, and of uniform width and height, in order that the finished ribbon 10 and/or dumpling 60 products lie flat and unobtrusively against the curtain C or fabric member with which it is to be used. In the preferred embodiment, the unit ribbon weight, or, alternatively, the unit dumpling weight, is selected by providing a relatively thicker or thinner weight, as best seen in comparison of the several weights 30 depicted within FIG. 5, the width and height dimensions being otherwise preferably unaffected.

As a non-limiting exemplary disclosure, weights 30 are approximately 1.05 inches wide×1.10 inches high, the only variable being the thickness thereof, as best seen with continuing reference to FIG. 5. A preferred thickness range for typical curtain applications is between approximately 0.070-0.100 inches. Within this thickness range, weights 30 will fall between approximately 10-28 grams each for galvanized steel materials.

It will be apparent to one of ordinary skill in the art that further adjustment of weight per unit length of weighted ribbon 10 may also be made by increasing or decreasing the spacing between weights 30, so that a greater or fewer number of weights 30 of preselected thickness are thusly disposed within weighted ribbon 10 per unit length. Yet additionally, the unit weight may be further affected by alternating, or even varying, thicknesses of weights 30 along the length of weighted ribbon 10.

In use, a preselected or precut section of weighted ribbon 10, or an individual dumpling 60, is sewn, as via thread 70, or otherwise affixed to curtain C or other fabric material member in a location and direction consistent with the intended use. As best seen with reference to FIGS. 6-10, this location may be within a formed hem H, in a seam, at a fabric margin, or otherwise at the user's discretion.

Figure 8:
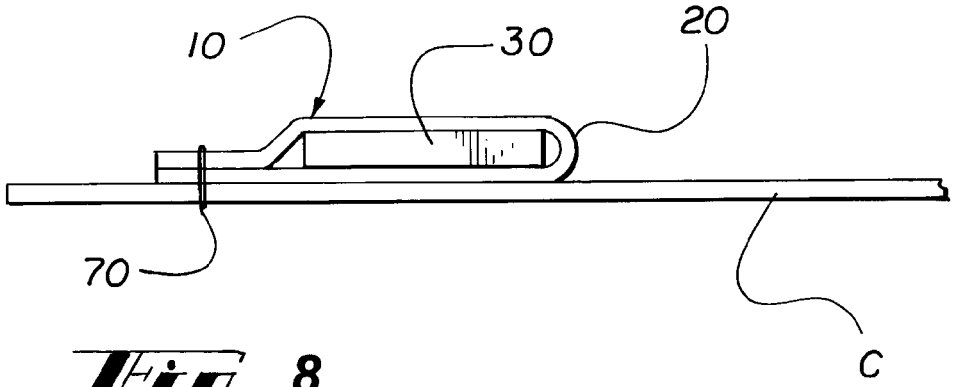
FIG. 8 is a sectional view of a curtain member, viewed from an edge thereof, showing a section of weighted ribbon of the present invention affixed in simple form to the curtain member.

For example, depicted in FIG. 8 is a section of curtain C, viewed from an edge thereof, showing a section of weighted ribbon 10 affixed in simple form to the curtain member.

Figure 9:
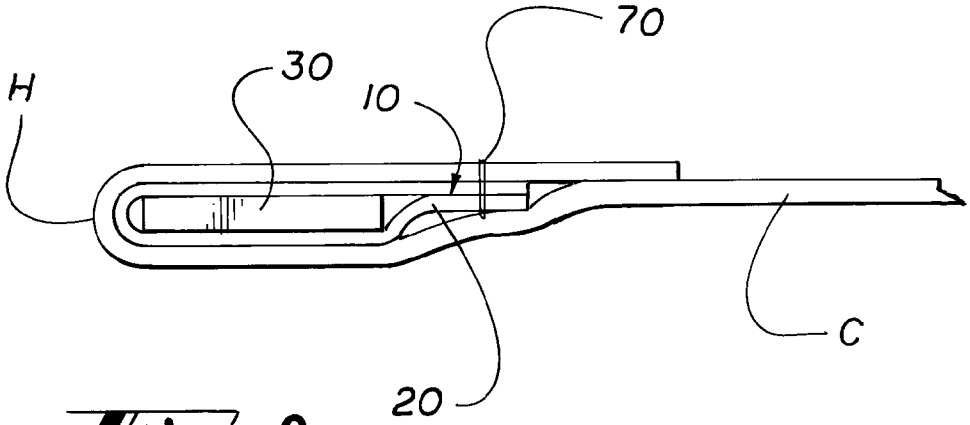
FIG. 9 is a sectional view of a curtain member, viewed from an edge thereof, showing a section of weighted ribbon of the present invention affixed within a hem of the curtain member.
Figure 10:
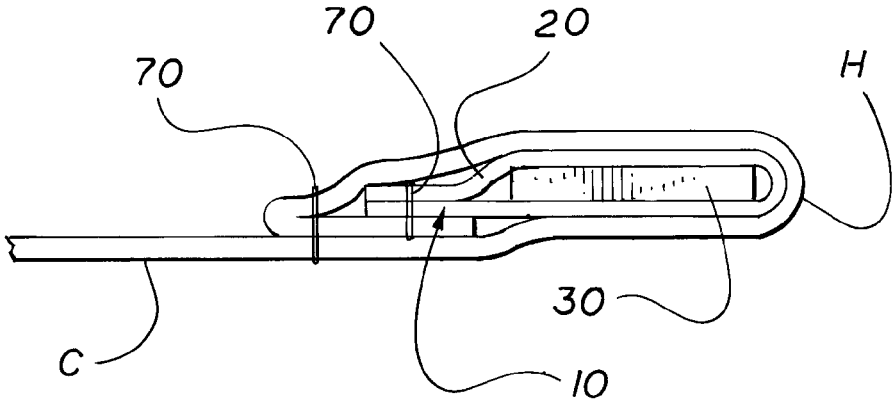
FIG. 10 is a sectional view of a curtain member, viewed from an edge thereof, showing a section of weighted ribbon of the present invention affixed within a doubled hem of the curtain member.
Figures 11, 12:
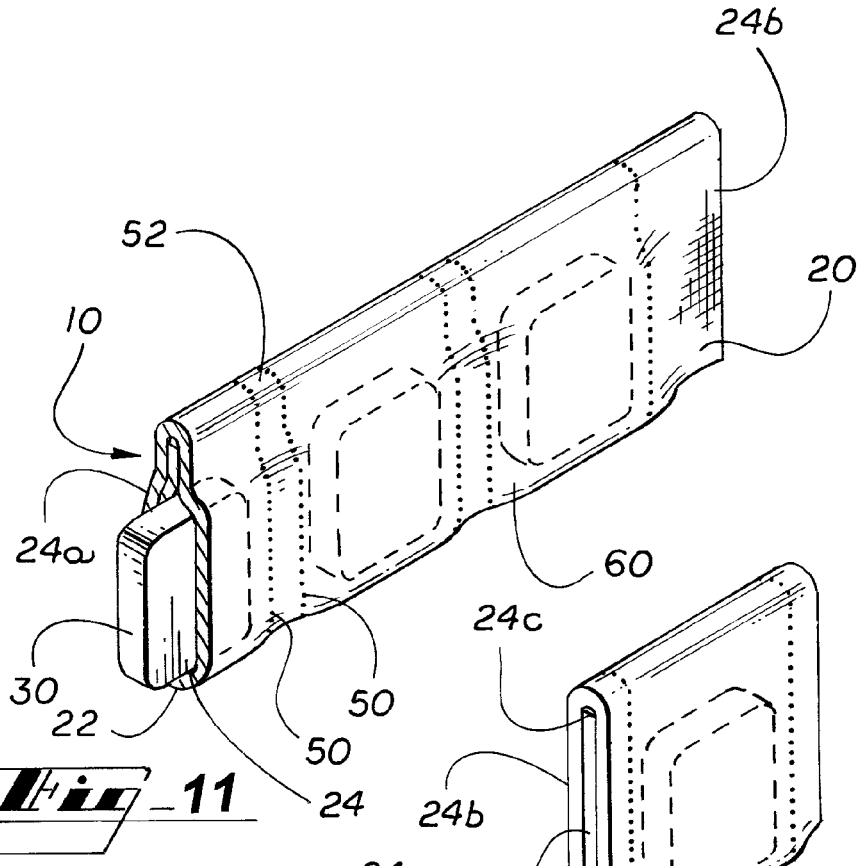
FIG. 11 depicts a portion of a weighted ribbon according to an alternate embodiment of the present invention, and shows a partial sectional view thereof.
FIG. 12 depicts an individual weight dumpling according to an alternate embodiment of the present invention.

Similarly, FIG. 9 depicts a section of curtain C, viewed from an edge thereof, showing a section of weighted ribbon 10 affixed within a hem H of the curtain member. Still further, FIG. 10 shows a section of curtain C, viewed from an edge thereof, showing a section of weighted ribbon 10 affixed within a doubled hem H of the curtain member.

In addition or as an alternative to sewing, the manner of affixing the weighted ribbon 10 or dumpling 60 to the curtain or other fabric member may also be via cooperating hook and loop fasteners, cooperating mechanical snap means, cooperating button and hole means, adhesives, adhesive tapes, or the like.

Thus, and uniquely advantageous to the present invention, the weight system described herein avoids the use of leaden weights; allows for convenient, safe, and secure separation of a larger "roll stock" of weighted ribbon 10 into smaller selected lengths of multi-weight ribbon 10, or into individual weight dumplings 60; provides for securely fused edges or seals, even upon cutting or separation of a larger "roll stock" of weighted ribbon 10 into smaller selected lengths of multi-weight ribbon 10, or into individual weight dumplings 60; avoids the use of sewn or stitched seams as a structural component of weighted ribbon 10; is pretreated to provide flame retardant characteristics or, alternatively, is inherently flame retardant; and is convenient and safe to fabricate and to use.

Figure 13:
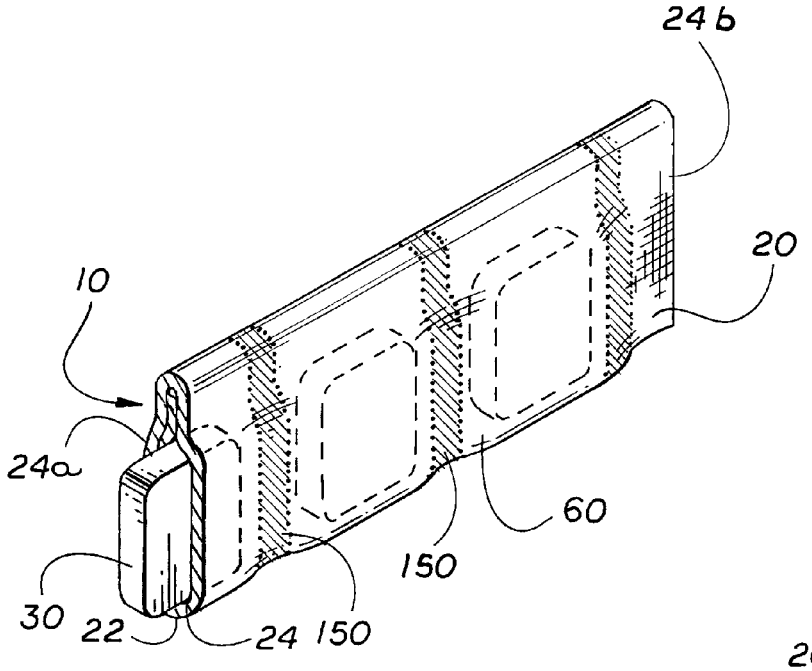
FIG. 13 depicts a portion of a weighted ribbon according to an alternate embodiment of the present invention, and shows a partial sectional view thereof.

In the alternate embodiments of FIGS. 11-13, 16, weighted ribbon 10 is formed by v-folding ribbon 20, along its length, to provide closed-end 22, and thus trough 24 for the receipt of uniformly dimensioned weights 30 therewithin. Advantageously in these embodiments, sufficient width of ribbon 20 is provided such that one or both of sides 24*a*, 24*b* of trough 24 may be reflexively folded over (i.e., along the longitudinal axis of weighted ribbon 10), such that one or both of top edges 24*c*, 24*d* of trough 24 resides adjacent side 24*a* (or side 24*b*) of trough 24, preferably proximate to closed-end 22. In this construction, longitudinal seal 40 becomes unnecessary, inasmuch as transverse double seals 50 (or transverse broad-single-seals 150, as shown in FIG. 13) would provide sufficient bond strength to form an integral construction of each segment of weighted ribbon 10. With this construction, cutting between double seals 50 would provide a dumpling 60 of the general form depicted in FIG. 12. Similarly, cutting between broad-single-seals 150 would provide a dumpling 60 of the general form depicted in FIG. 16.

In a further alternate embodiment, ribbon 20 of the present invention may be fabricated to include use of a supplemental binding or sealing material or agent, in order to increase or enhance the strength of seals 40, 50, 150.

Generally, the several embodiments of weighted ribbon 10 of the present invention may be manufactured pursuant to the following method: providing ribbon 20 formed of a woven, fusible fabric; folding ribbon 20 along its longitudinal length to provide closed-end 22 and to thus define trough 24 having sides 24*a*, 24*b* and top edges 24*c*, 24*d*; providing a plurality of weights 30; disposing each weight 30 of the plurality of weights in spaced array within trough 24; closing trough 24 to maintain the plurality of weights 30 therewithin; and, forming, in ribbon 20, at least one transverse seal 50 or 150 between each weight 30 disposed within trough 24. The at least one transverse seal 50 or 150 provides for a digitally-defined section for transverse division of weighted ribbon 10 into discrete lengths (of either selected lengths of multi-weight ribbon 10 and/or individual weight dumplings 60), without loss of a weight 30 adjacent to a transverse division of the weighted ribbon 10, and without substantial fraying of ribbon 20 proximate a transverse division.

More specifically, the step of forming, in ribbon 20, at least one transverse seal comprises the step of forming, in ribbon 20, a transverse double seal 50 between each weight 30 disposed within trough 24, and wherein transverse double seal 50 comprises an unsealed region 52 therebetween, and wherein unsealed region 52 constitutes the digitally-defined section for transverse division of weighted ribbon 10 into discrete lengths. Alternatively, the step of forming, in ribbon 20, at least one transverse seal comprises the step of forming, in ribbon 20, a transverse broad-single-seal between each weight 30 disposed within trough 24, and wherein the transverse broad-single-seal constitutes the digitally-defined section for transverse division of weighted ribbon 10 into discrete lengths. In either instance, the at least one transverse seal 50 or 150 between each weight 30 extends from closed-end 22 substantially to top edges 24*c*, 24*d* of trough 24, and wherein the at least one transverse seal 50 or 150 between each weight 30 serves as a fray-reduction and/or a fray-stopping element upon transverse division of weighted ribbon 10.

The step of closing trough 24 comprises the step of forming longitudinal seal 40 proximate top edges 24*c*, 24*d* of trough 24. Alternatively, the step of closing trough 24 comprises the step of reflexively folding over at least one of sides 24*a*, 24*b* of trough 24 such that at least one of top edges 24*c*, 24*d* of trough 24 resides adjacent a side 24*a* or 24*b* of trough 24, preferably proximate closed-end 22.

Applications for the weighting systems of the present invention, whether of ribbon or dumpling type, may include stage curtains, such as main curtains, valences, borders, legs, rear stage curtains, mid-stage curtains, lambrequins, tormentors, cycloramas, sharkstooth scrims, back-drops, bounce drops, Lenos, Kabuki curtains, masking curtains, and the like. Similarly, the weighting systems of the present invention may be used in association with plastic or vinyl sheeting for industrial applications. Additionally, the weighting systems of the present invention may be used in awnings, sails, shades, draperies, divider curtains, exhibit curtains, wraparound masking for tables and displays, trade show booth masking, cubicle curtains in hospitals and health care facilities, home theater curtains, casements, shears, black-out curtains, linings, and the like.

Having thus described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

What is claimed is:

1. A method of producing a weighted device for use in a curtain or other fabric member, said method comprising the steps of:

providing a ribbon formed of a woven, fusible fabric;

folding said ribbon to form a closed end along the length of said ribbon, and to thereby form a trough, said trough comprising sides and top edges;

providing a plurality of weights;

disposing each weight of said plurality of weights in spaced array within said trough;

closing said trough;

forming a plurality of transverse seals in said ribbon to provide a weighted ribbon wherein at least one transverse seal of said plurality of transverse seals is formed between each weight disposed within said trough, and wherein each transverse seal of said plurality of transverse seals comprises a section for cutting said weighted ribbon, wherein a cut can be made through any said section of any said transverse seal to separate from said weighted ribbon at least one selected length of multi-weight ribbon or at least one individual weight dumpling, and wherein any said cut through any said section of any said transverse seal can be made without loss of a weight adjacent to any said cut, and without substantial fraying of said ribbon proximate to any said cut; and, cutting through any said section of any said transverse seal to separate from said weighted ribbon said at least one selected length of multi-weight ribbon or said at least one individual weight dumpling, said at least one selected length of multi-weight ribbon or said at least one individual weight dumpling to be used in a curtain or other fabric member.

2. The method of claim 1, wherein each said transverse seal of said plurality of transverse seals is a transverse double seal.

3. The method of claim 2, wherein each said transverse double seal comprises an unsealed region therebetween, and wherein each said unsealed region comprises a said section for cutting said weighted ribbon.

4. The method of claim 1, wherein each said transverse seal of said plurality of transverse seals is a transverse broad-single-seal.

5. The method of claim 4, wherein each said transverse broad-single-seal comprises a said section for cutting said weighted ribbon.

6. The method of claim 1, wherein each said transverse seal of said plurality of transverse seals extends from said closed-end substantially to said top edges of said trough.

7. The method of claim 1, wherein each said transverse seal of said plurality of transverse seals serves as a fray-reduction element upon cutting through any said section of any said transverse seal.

8. The method of claim 1, wherein each said transverse seal of said plurality of transverse seals serves as a fray-stopping element upon cutting through any said section of any said transverse seal.

9. The method of claim 1, wherein said step of closing said trough comprises the step of forming a longitudinal seal proximate to said top edges of said trough.

10. The method of claim 1, wherein said step of closing said trough comprises the step of reflexively folding over at least one of said sides of said trough such that at least one of said top edges of said trough resides adjacent a side thereof.

11. The method of claim 1, wherein said step of closing said trough comprises the step of reflexively folding over at least one of said sides of said trough such that at least one of said top edges of said trough resides proximate to said closed-end.

12. The method of claim 1, wherein said ribbon is imbued with flame retardant characteristics.

13. The method of claim 1, wherein each said weight of said plurality of weights is relatively flat.

14. The method of claim 1, wherein each said weight of said plurality of weights is of relatively uniform height and length.

15. The method of claim 1, wherein each said weight of said plurality of weights is substantially square in shape.

16. The method of claim 1, wherein each said weight of said plural plurality of weights is lead-free.

17. The method of claim 1, wherein each said weight of said plurality of weights is made of a non-staining metal.

18. The method of claim 1, wherein each said transverse seal of said plurality of transverse seals is formed utilizing a sealing process selected from the group consisting of ultrasonic sealing and heat sealing.

19. The method of claim 9, wherein said longitudinal seal is formed utilizing a sealing process selected from the group consisting of ultrasonic sealing and heat sealing.

* * * * *